US009757959B2

(12) United States Patent
Whitmarsh et al.

(10) Patent No.: US 9,757,959 B2
(45) Date of Patent: Sep. 12, 2017

(54) DETERMINING THE PRINT PATH OF A PRINTING DEVICE

(75) Inventors: Mike Whitmarsh, Vancouver, WA (US); Cornelius J. O'Donnell, San Marcos, CA (US); William E Hertling, Portland, OR (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 351 days.

(21) Appl. No.: 13/459,657

(22) Filed: Apr. 30, 2012

(65) Prior Publication Data

US 2013/0287464 A1 Oct. 31, 2013

(51) Int. Cl.
*B41J 3/60* (2006.01)
*B41J 13/00* (2006.01)

(52) U.S. Cl.
CPC ..... *B41J 3/60* (2013.01); *B41J 13/0009* (2013.01)

(58) Field of Classification Search
None
See application file for complete search history.

(56) References Cited

U.S. PATENT DOCUMENTS

| | | | | |
|---|---|---|---|---|
| 7,365,870 | B2 | 4/2008 | Ferlitsch | |
| 7,756,437 | B2 | 7/2010 | Kadota | |
| 2005/0073696 | A1 | 4/2005 | Mackenzie et al. | |
| 2008/0152375 | A1* | 6/2008 | Kadota | 399/81 |
| 2010/0165365 | A1* | 7/2010 | Fujii | 358/1.9 |
| 2010/0225932 | A1* | 9/2010 | Kurose et al. | 358/1.1 |
| 2011/0002721 | A1 | 1/2011 | Yamazaki | |

OTHER PUBLICATIONS

How to Print Double Sided, howtoguides 365, pp. 1-3, Retrieved from Internet on Apr. 5, 2012, Available at: <howtoguides365.com/how-to/print-double-sided/>, Copyright 2012 Howtoguides.com.

* cited by examiner

*Primary Examiner* — Marivelisse Santiago Cordero
*Assistant Examiner* — Keara Harris
(74) *Attorney, Agent, or Firm* — HP Inc. Patent Department

(57) ABSTRACT

System and methods are disclosed for determining the print path of a printer to facilitate manual duplexing. The method includes instructing a printing device to print a first object on a first side of a test sheet and then instructing a user to reinsert the test sheet in the printing device. The printing device is then instructed to print a second object on the test sheet. The user can further provide information indicating a location of the second object with respect to the first object. Based on the information, the printing path of the printer is determined.

15 Claims, 5 Drawing Sheets

DETERMINING THE PRINT PATH OF A PRINTING DEVICE

BACKGROUND

Most low-cost printers do not include the hardware feature to print on both sides of a sheet of paper. This feature is often known as automatic duplexing. Some types of print output, such as booklet printing, require that the print output is on both sides of the paper. Other times a user may desire to print double sided for a variety of reasons, such as environmental or economical based reasons. In order to achieve double sided printing where automatic duplexing is not available, manual duplexing can be performed. Manual duplexing prints first on one side of the pages, then asks the user to reinsert the paper to print the opposite side. However, the problem for software when configuring a manual double sided print job is that the device print path must be known.

DETAILED DESCRIPTION

Figure 1:
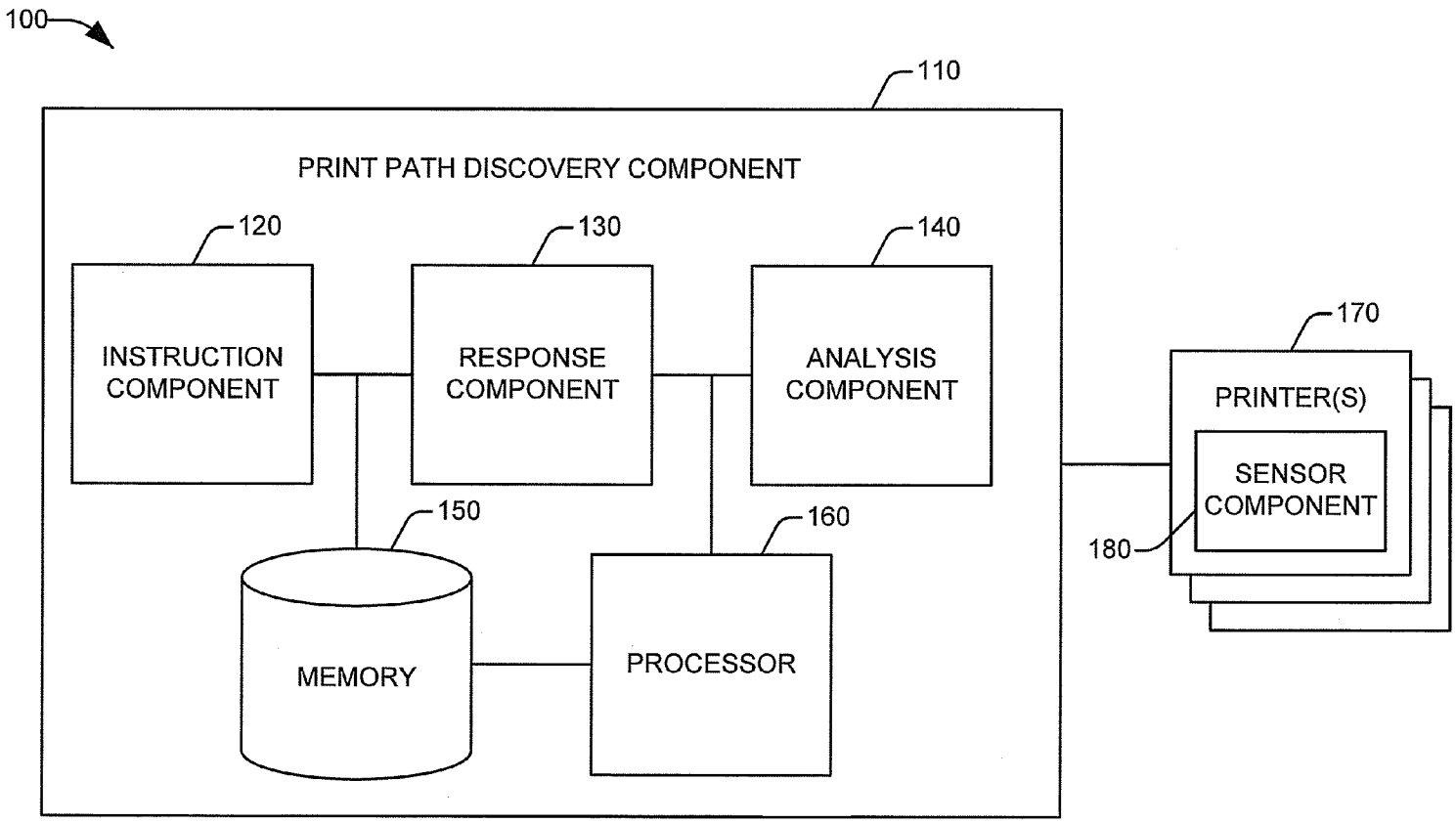
FIG. 1 illustrates an example non-limiting high level block diagram of a system for determining the printing path of a printer in accordance with various aspects and implementations described herein.

One or more implementations of the present disclosure are described with reference to the attached drawings, wherein like reference numerals are used to refer to like elements throughout. Disclosed are systems and methods for determining the printing path of a printer so that a user can manually perform double sided printing jobs with the printer. In order to configure a manual double sided print job, the software must know whether the printed pages will come out face up, or face down, whether the printed pages should be placed into loading the tray of the printer print side up or print side down, and finally whether the printer inverts the printout.

One solution to the above noted problem includes using a printer driver to perform manual duplexing. However, print drivers are only effective when the user has installed a sophisticated print driver that performs manual duplexing at the user's computing device. Nevertheless, many users no longer install full featured drivers, or use operating systems that do not have printer drivers that support manual duplexing. Furthermore, printing software may be located on a website or web application rather than a user's personal computer.

Provided herein are various non-limiting aspects for determining a device print path so that printing software can correctly render pages and instruct a user in association with performing manual duplexing. This allows the printing software to correctly render front and back pages in the correct order and direction for easy manual duplexing by the user. The method reduces or eliminates the need for complex drivers to determine the printing path of the printer or a database that stores printing paths for a plurality of networked printers.

The method involves instructing a user/printer to print a test page comprising four boxes in respective corners of the test page and instructing the user to reinsert the test page into the printer. The method further includes instructing the user/printer to print an object on the test page after being reinserted. The method then requests the user/printer to provide information indicating the location of the object with respect to the four boxes. In response to receipt of the information, the printing path of the printer is determined. The printing path can further be employed by various systems to facilitate double sided printing at the printer.

In particular, duplex printing and manual duplex printing, including supporting software to print all the odd sides, that instruct the user to reload the copies, then print all the even sides, are existing technologies. Some of these technologies are application based and work only with a particular application. Other methods are more general, but are still platform- and operating system-dependent. For example, these methods capture a user's job from the Windows operating system and then use Windows-specific software involving a print dialog box to print only odd pages or even pages, thus enabling the job to be manually duplex printed if the paper is properly reoriented manually between the two printings.

The subject method and systems further provide a platform-independent system and method for manual duplex printing that clearly identifies the manual duplex printing capabilities of a printer and removes the guesswork from reorientation of the paper printed on a first side when reloading for second side printing. In particular, in various embodiments, print path discovery is performed at a cloud deployed server where the server is not directly connected to the users printer. Rather, a user interacts with a print path discovery server via a browser at a client device that connects to the printer. The cloud based server is responsible for rendering the print job and determining how to render the two parts of the job so that it results in a properly formatted duplex job.

Referring now to the drawings, with reference initially to FIG. 1, presented is an exemplary high level block diagram of a system 100 for determining the printing path of a printer. Aspects of the systems, apparatuses or processes explained herein can constitute machine-executable components embodied within machine(s), e.g., embodied in one or more computer readable mediums (or media) associated with one or more machines. Such components, when executed by the one or more machines, e.g., computer(s), computing device(s), virtual machine(s), etc. can cause the machine(s) to perform the operations described. System 100 can include memory 150 for storing computer executable components and instructions. A processor 160 can facilitate operation of the computer executable components and instructions by the system 100.

In an embodiment, system 100 includes a print path discovery component 110 and one or more printers 170. The one or more printers 170 can include any type of printer having various functionalities. In an aspect, the one or more printers can include a printer configured to perform automatic duplexing. As used herein, the term duplexing refers to printing on two sides of a sheet or printing double sided. In another aspect, the one or more printers can include a printer that is not configured to perform automatic duplexing. Systems and methods disclosed herein relate to discovery of a print path of the one or more printers 170 such that a user can perform manual duplexing with the printer (regardless as to whether the printer is configured to perform automatic duplexing or not).

One or more components of print path discovery component 110 can be employed in a printer 170 and/or in a computing device connected to or configured to connect to printer 170, either directly or indirectly via another device (e.g. a client device). The one or more printers can employ any suitable means to connect to print path discovery component 110. In an aspect, a printer 170 can connect to print path discover component via a wired connection (e.g. using a printer cable or a universal serial bus (USB) cable). In another aspect, a printer 170 can connect to print path discovery component via a wireless connection (e.g. via a network or a short distance wireless technology). In another aspect, a printer may connect to a client device (not shown), either wirelessly or via a wired connection. In turn the print path discovery component 110 may connect to the client device (e.g. via a network).

System 100 depicts memory 150 and processor 160 within the print path discovery component 110, however system 100 (and additional systems disclosed herein), is not restricted to such a configuration. In an aspect, memory 150 and processor 160 can be associated with a device that employs print path discovery component 110. For example, print path discovery component 110 can be employed in any suitable computing device configured to communicate with one or more printers 170. For example, a suitable computing device can include but is not limited a server, a desktop computer, a laptop computer, a smart-phone, a tablet personal computer (PC), a smart printer, or a PDA. In another aspect, print path discovery component 110 can be employed within a printer 170.

In an aspect, a device employing print path discovery component 110 can include at least one input interface for interfacing with the print path discovery component 110 (e.g. providing input to the print path discovery component 110), and an output device, such as a display screen, speaker, and etc. for providing information to a user of the print path discovery component 110. In an embodiment discussed infra, the print path discovery component is provided on a server and accessed via a client device. According to this aspect, the client device can include hardware and software means for interfacing with the print path discovery component 110.

In an embodiment, print path discovery component 110 can include an instruction component 120, a response component 130, and an analysis component 140. In an aspect, the instruction component 120 instructs a user (e.g. a printer 170) to print a first object on a first side of a test sheet. The instruction component 120 further instructs the user to reinsert the test sheet into the printing device, and instructs the user device to print a second object on the test sheet. The response component 130 receives information from the user indicating a location of the second object with respect to the first object. An analysis component 140 then determines the printing path of the printing device based on the information. As used herein, the term print path is used to refer to the manner in which a printer feeds a sheet through the printer and affixes an object (e.g. an image or text).

Instruction component 120 provides instructions that include various steps or actions for a user to perform in association with printing a test page and learning the results of the test page. In an embodiment, the instruction component can bypass user assistance and directly communicate one or more instructions to the printer. In an aspect, the instruction component 120 instructs a user/printer to print a test page in response to a request for a double sided printing job at a printer 170. According to this aspect, prior to initiating the double sided printing job, the instruction component 120 instructs the user/printer to print a test page having a first object thereon. As discussed infra, the first object can include four boxes, one box in each of the four corners of the page.

In an aspect, the instruction component 120 can employ an output device associated with the device in which the print path discovery component 110 is employed to provide information and/or instructions to a user. For example, the instruction component may present a prompt at a display screen of a hosting device (e.g. a computer used to schedule the double sided print job). The prompt can provide informing to a user that a user assisted manual duplexing configuration process is required or suggested, prior to initiating the requested double sided print job. The instruction component 120 can further present a user with a step by step interactive series of prompts to assist the user in carrying out the configuration process. For example, the instruction component 120 may present a prompt that commands a user to print a test page at a printer 170. In another example the instruction component 120 may present a prompt that provides a user with a command icon to select that initiates printing the test page in response to selection. In another example, the instruction component 120 may merely indicate to a user that a test page will print in response to a command communicated to the printer via the print path discovery component.

Once the test page is printed (for the first time), the instruction component 120 then instructs the user to reprint the test page. In particular, the instruction component 120 can instruct the user to place the printed test page back into the printer so that a second object can be printed on the test page. The instructions can include details with how the user should place the printed test page back into the loading tray of the printer. For example, the instructions may tell the user to place the printed page into the loading tray of the printer 170 such that the object is facing the user and located at the top end of the page (i.e. not inverted). In an aspect, the instruction component 120 can provide the user instructions via visual instructions (i.e. an interactive prompt or an video). For example, the instruction component 120 may provide a prompt with an image indicating the manner in which the user should place the printed test page back into the loading tray. In another aspect, the instruction component 120 can provide audible instructions (i.e. voice commands).

In an embodiment, the instruction component 120 can request the user to initiate printing a second object on the test page as formatted by the print path discovery component 110. In an aspect, the instruction component 120 can request the user to press a print button on the printer or a print icon associated with an interactive prompt, in order to initiate printing a second object on the test page. In yet another aspect, the instruction component 120 can present a user with a prompt asking if the printed test page has been correctly reinserted into the loading tray of the printer 170. In response to receipt of an affirmative answer, the instruction component 120 can initiate printing a second object on the test page via sending a command to the printer 170. The second object can include an X, a check mark, or any other suitable mark, in a corner of the test page.

In an embodiment, response component 130 receives information from a user indicating a location of the first object with respect to the second object on the printed test sheet. For example, the instruction component 120 and/or the response component 130 can present the user with a question or a prompt asking the user to indicate where the first object is with respect to the second object. A user can further employ an interfacing device associated with the device employing print path discovery component 110, to provide the print path discovery component 110 the information. For example, the interfacing device may include but is not limited to, a keyboard, a keypad, a mouse, a touch screen, a camera, a scanner, or a microphone.

In an aspect, the response component 130 may present the user with a series of yes/no questions asking the user whether the first object is located in a specific location with respect to the second object. The response component 130 can stop the questioning in response to an affirmative answer. In another example, the response component 130 may present a user with an interactive image and ask the user to select the location, on the image, of the first object with respect to the second object. It should be appreciated that a variety of mechanisms to facilitate efficiently and effectively gathering information from the user with minimal user effort are contemplated within the spirit of the subject disclosure.

Once the response component 130 has received the information regarding the location of the first object with respect to the second object on the test page, the response component can provide the information to the analysis component 140. Analysis component 140 employs the information regarding the location of the first object with respect to the second object on the test page provided by the user in order to determine the print path of the printer 170. Analysis component 140 can employ a variety of mechanisms in order to determine the print path of a printer based on user provided information. In an aspect, the analysis component 140 employs a look-up table storing information relating a location of a first object to a location of a second object and a printer print path. In another example, the analysis component 140 can employ one or more algorithms that equate the print path of a printer based on the user provided location information.

According to an embodiment, print path discovery component 110 can employ additional mechanisms in association with printing of a test page, in order to determine the print path of a printer. According to this embodiment, detection of a printers print path can be performed in an automated or semi-automated manner by print path discovery component 110 in association with printing of the test page. In particular, print path discovery component 110 can capitalize on one or more sensors and/or hardware associated with a printer 170, a device employing print path discovery component, or accessing print path discovery component via a network, to facilitate intelligent learning of printing mechanisms of the printer 170. The instruction component 120 can instruct the hardware and/or the user to employ the hardware, to perform actions that generate additional information relating to the print path of a printer in association with printing a test page. In turn, the analysis component 140 can employ the additional information to facilitate determining the printing path of the printer in an automated fashion.

In an aspect, one or more printers 170 can include a sensor component 180. Sensor component 180 can include one or more sensors, including but not limited to, a camera, a motion sensor, an acoustic sensor, a vibration sensor, an optical sensor, pressure sensor, a chemical sensor, a thermal sensor. Further, sensor component 180 can include any auxiliary hardware associated with a printer 170 capable of generating information that can be utilized by print path discovery component 110 to determine the printing path of the printer 170. For example, such auxiliary hardware can include but is not limited to, a scanner, a copier, a faxing component, or a robotic arms device.

In an aspect, the instruction component 120 can instruct the user/printer to initiate sensing component 180 to perform one or more actions in association with printing a test page. The actions can further generate additional information that the user can observe and provide to print path discovery component, and more particularly, that the printer can transmit to the print path discovery component 110. For example, the sensor component 180 may include a camera or scanner. The instruction component 120 can instruct a user to command the printer to perform actions utilizing the scanner and/or camera, and/or the instruction component 120 can directly command the printer to perform scanning or camera functions. The instructions can supplement instructions for printing a test page. For example, the instructions can include instructions to scan the test page as it passed through the print path when printing the second object (as some printers do in order to detect paper type or to align print cartridges). In turn, the scanned image can be provided to print path discovery component 110 and analysis component 140 can utilize imaging analysis software to determine where the X mark is located.

In another aspect, the user could hold the twice printed test page up to a camera on the printer which can in turn present an image to the print path discovery component. The analysis component 140 can further utilize imaging analysis software to determine where the X is. It can further be appreciated that the camera can be provided on a device employing print path discovery component 110 and/or a client device accessing a cloud based server employing the print path discovery component. For example, the instruction component 120 can instruct the user to hold a twice printed page up to the camera located on the client device that is a web based camera. The camera can then capture a live or still image of the twice printed page and provide the image to the analysis component 140 for analysis.

In another example, a three dimensional printer may have spin or rotate functions. In order to detect the manner in which a printer spins or rotates, the instruction component 120 may send the printer command to perform spinning or rotating further command a camera or sensor associated with the printer to observe/record the manner spinning/rotation. In another example, where printer include robotic arms to load print pages or perform other functions, the instruction component 120 can send commands to initiate a motor mechanism used to move the robotics arms. The movement of the robotic arms in response to the command signals can be observed via cameras or motions sensors associated with the printer, and the information can be provided to the analysis component 140. In turn, the analysis component 140 may employ the information to determine the printing path of the printer and/or the manner in which pages are loaded by the printer. In response to determining the print path of a printer and/or additional information regarding the printing mechanisms of a printer, the analysis component 140 can provide the information to various systems that facilitate carrying out printing jobs or operations with the printer. For example, the analysis component can provide the print path of the printer to an operating system of a device requesting a double sided print job so that the operating system can configure a double sided printing job. In another aspect, the analysis component 140 can provide the print path to a software component that configures doubles sided print jobs requests. Still in yet another aspect, analysis component 140 can configure a double sided print job request. Further, the analysis component 140 can provide the information to various systems so that the systems can instruct a user how to reinsert pages of a double sided print job in association with the ordering. For example, instructions may include "remove the paper from the output tray and place in the input tray without rotating or flipping." Similarly, the analysis component may determine and provide reinsertion instructions associated with a double sided print job.

Configuration of a double sided print job includes determining an order in which to print on pages as a function of the print path of the printer and anticipation of reinsertion of pages into a printer in a predetermined manner. With manual duplexing, a printing job is divided into two portions. A first portion of the printing job is printed on a first side of respective sheets and then the sheets are reinserted into the printer for printing a second portion of the printing job on respective second side of the sheets. When performing manual duplexing, the order in which the sheets are printed is determined so that the resulting final printed document is correctly ordered front to back on the printed pages. Configuration of a double sided print job therefore requires determining an order in which to print on pages. Furthermore, in more complex printing jobs, such as those requiring booklet printing, the configuration may further encompass the imposition of logical pages into a physical layout, such that the order, orientation, and placement of pages produces the desired final output when printed and assembled into a booklet.

In an embodiment, analysis component 140 is further configured to determine the manner in which a user should reinsert printed pages of a first portion of a double sided print job such that the resulting document is printed with print on the front and back sides of the sheet in the proper orientation and order after the second portion of the double sided print job is carried out. For example, if the user incorrectly places printed pages back into the printer for printing on the back sides thereof, the resulting document may have print on the same side of the sheets (e.g. overlapping), print overlapping and inverted on the sheets, print on the front and back sides of the sheets yet inverted with respect to the front, or print on the front and back sides of the sheets yet in an order that does not correspond to the print on the front sides of the sheet.

Accordingly, the analysis component 140 may determine the printing order for a double sided print job and the manner in which a user should reinsert the sheets of the second portion of the double sided print job, based on the print path of the printer. For example, the manner of reinsertion may be to place the pages of the second portion of the pages into the loading tray of the printer so that the non-printed side is facing forward and so that the pages are inverted. The analysis component 140, may employ information stored in memory 150 and/or one or more preconfigured algorithms in order to determine the correct manner of reinsertion of pages of a second portion of a double sided print job.

In an embodiment, the instruction component 120 can further instruct the user how to reinsert pages of a second portion of a double sided print job, as determined by the analysis component 140, based on the print path of the printer. In particular, the instruction component 120 can instruct the user how to reinsert one or more printed pages into the printer, based on the printing path, so that the printer can perform a second portion of a double sided printing job such that a first side of the one or more printed pages has print thereon in predetermined orientation with respect to a second side of the one or more printed pages, wherein the one or more printed pages have print thereon as a result of a first portion of the printing job.

In an aspect, the instruction component 120 can instruct a user how to reinsert pages prior to the initiation of the double sided print job. In another aspect, the instruction component 120 can instruct a user how to reinsert pages of a double sided print job after the first portion of the double sided print job is complete. The instruction component 120 may employ a variety of mechanisms in order to provide reinsertion instructions to a user. In an aspect, the instruction component 120 can provide the user with a video or image prompt presenting images indicating the proper manner of insertion of pages.

In an embodiment, once the analysis component 140 has determined the print path of a printer using the subject manual assisted configuration process, the analysis component 140 can store information in memory 150, or other memory (not shown) remote from print path discover component 110. For example, the analysis component 140 can associate printer identification information with a printers determined print path. Therefore, when the printer or similar printer is employed in the future, the print path discovery component 110 can merely provide the stored information indicating the print path.

Figure 2:
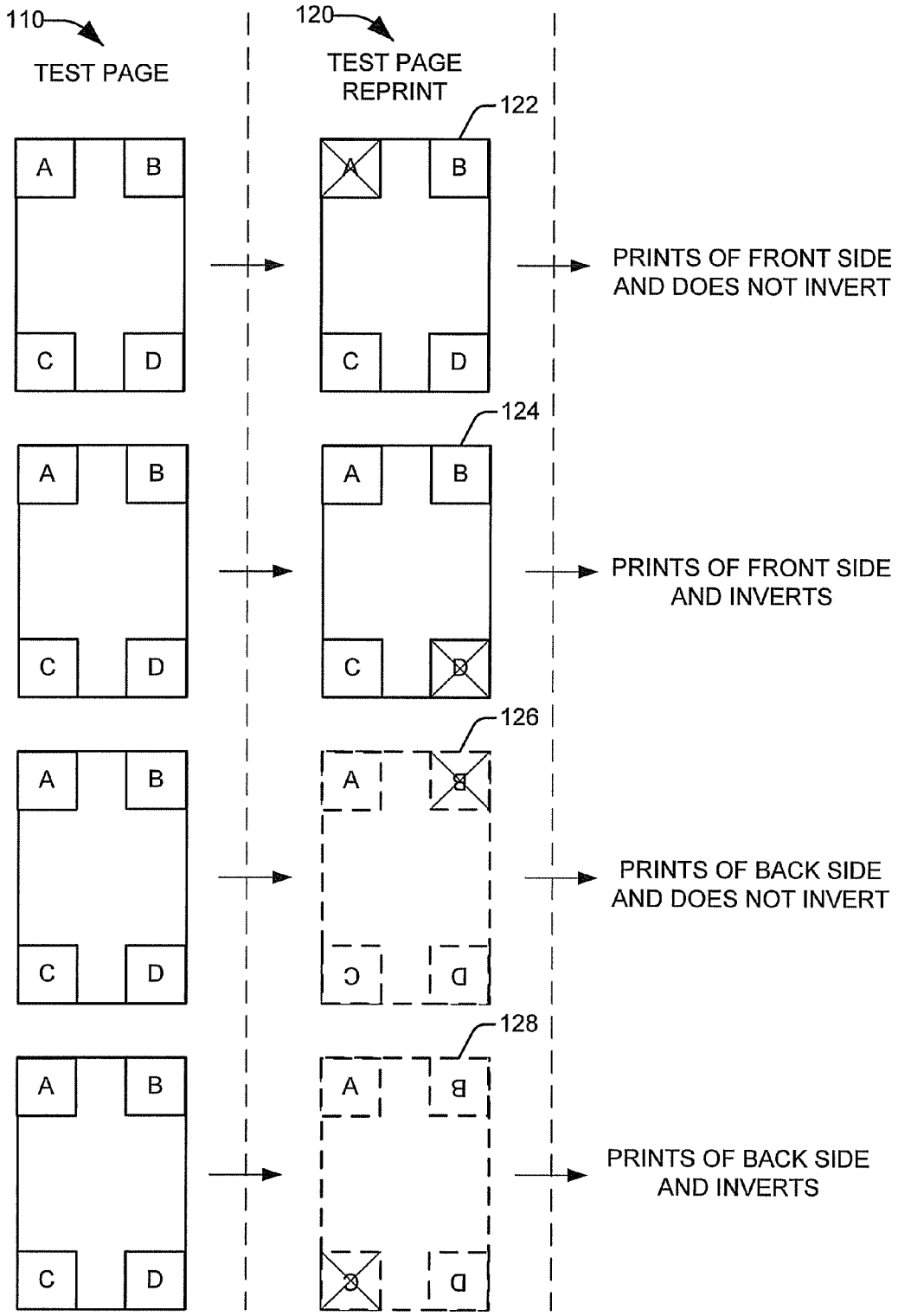
FIG. 2 illustrates an example non-limiting test page printouts and related information in accordance with one or more aspects for determining a printing path of a printer in accordance with various aspects and implementations described herein.

Referring now to FIG. 2, illustrates a test page printouts and related information in accordance with one or more aspects for determining a printing path of a printer. In an aspect, when a test page is first printed with a first object, the first object can include four boxes in the respective corners of the page. As seen in FIG. 2, column 110 presents four identical test pages printed with four boxes in the respective corners of the page. The boxes can be any suitable size. In an aspect, the boxes have dimensions of one inch by one inch. The boxes can also include identifiers. For example, the boxes of the test pages in column 110 of FIG. 2 include the letter A in the upper left hand corner box, the letter B in the upper right hand corner box, the letter C in the lower left hand corner box, and the letter D in the lower right hand corner box. The four boxes (e.g. the first object), are printed on the front side of the test page.

After a test page is printed with the first object, (e.g. the four boxes), the instruction component 120 can instruct a user to reinsert the test page into the printer for printing of a second object. As seen in FIG. 2 the second object can include single X. The instruction component 120 can be configured to instruct the printer to print an X in one of four corners of the test page, depending on the print path of the printer. The instruction component 120 can further instruct the user to reinsert the test page into the printer in a predetermined manner. For example, the instruction component 120 can instruct a user to reinsert the test page into the loading tray of the printer so that the four boxes are facing the user or towards the front of the printer and so that the box with the letter A is in the top right corner.

In an aspect, the analysis component 140 determines the print path of a printer based on user provided information indicating the location of an X following a reprint of the test page with respect to the four boxes. In another aspect, the analysis component 140 can observe the location of X following a reprint of the test page via an image provided by a scanner, or a camera. According to this aspect, there are four possibilities of print paths corresponding to a two by two matrix of two factors. The factor is that the printer prints on the front of each sheet verses the back (e.g. a first side verses a second side). The second factor is that the printer inverts the printout verses does not invert.

Column 120 depicts the test page after it has been reprinted or printed with the second object. Reprinted test page 122 depicts the front side of the test page. Reprinted test page 122 includes an X in the box with the letter A. In an aspect, when a reprinted test page includes an X in the box with the letter A, the analysis component 140 determines that the print path includes the printer printing on the front side of the page and does not invert. Reprinted test page 124 depicts the front side of the test page. Reprinted test page 124 includes an X in the box with the letter D. In an aspect, when a reprinted test page includes an X in the box with the letter D, the analysis component 140 determines that the print path includes the printer printing on the front side of the page and does invert. Reprinted test page 126 depicts the back side of the test page. Reprinted test page 126 includes an X in the box with the letter B. In an aspect, when a reprinted test page includes an X in the box with the letter B, the analysis component 140 determines that the print path includes the printer printing on the back side of the page and does not invert. Reprinted test page 128 depicts the back side of the test page. Reprinted test page 128 includes an X in the box with the letter C. In an aspect, when a reprinted test page includes an X in the box with the letter C, the analysis component 140 determines that the print path includes the printer printing on the back side of the page and inverts.

Figure 3:
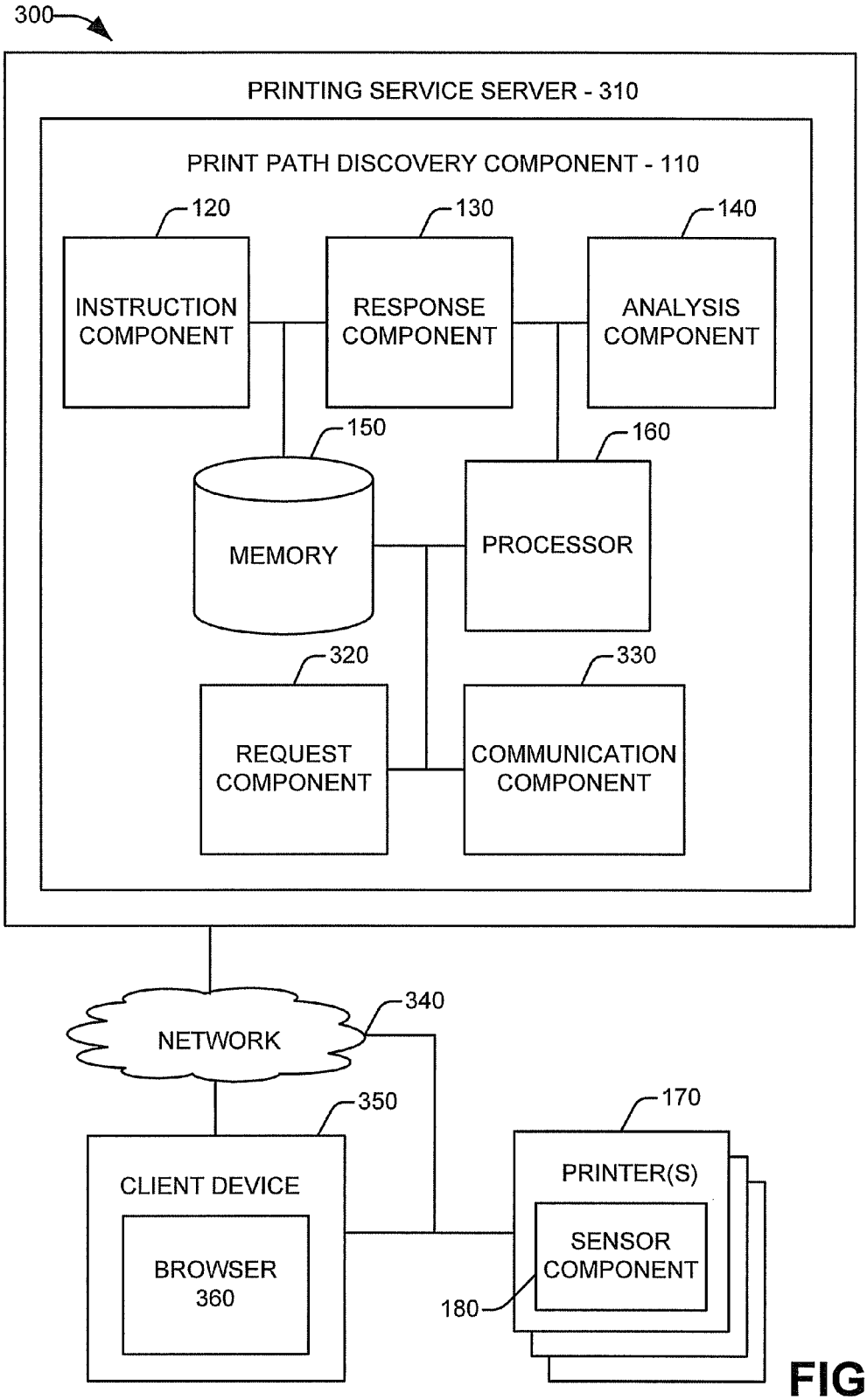
FIG. 3 illustrates another example non-limiting another high level block diagram of a system for determining the printing path of a printer in accordance with various aspects and implementations described herein.

Referring now to FIG. 3, presented is another exemplary high level block diagram of a system 300 for determining the printing path of a printer via a print path discovery component 110 provided at a networked server. System 300 depicts printer service server 310 that comprises print path discovery component 110. System 300 further depicts a client device 350 that communicates with print printing server 310 via a network 340. Network 340 can include any suitable network that enables communication between printing service server 310, client device 350, and one or more printers 170. For example, the network 340 can include the Internet, an intranet, or a cellular service. In addition, print path discovery component 110 can include a communication component 330 and a request component 320. In an aspect, network 340 can be employed by communication component 330 to enable wireless communication between printing service server 310 employing print path discovery component 110 and a client device 350. In addition, in an aspect, client device 350 can employ network 340 to communicate with one or more printers 170, and printing service server 310 can employ network 340 to communicate with one or more printers 170.

System 300 depicts an embodiment where print path discovery is performed at a cloud deployed server where the server is not directly connected to the users printer. Rather, a user interacts with a print path discovery server via a client device 350 (e.g. through a browser 340) that connects to the printer. Client device 350 can include any suitable computing device, including but is not limited a desktop computer, a laptop computer, a smart-phone, a tablet personal computer (PC), or a PDA. The cloud based server 310 is responsible for rendering the print job and determining how to render the two parts of the job so that it results in a properly formatted duplex job. According to this aspect, the print path discovery component does not need to have a direct connection to the one or more printer 170 in order to determine the printing path of the one or more printers. Instead, the print path discovery is dependent on the printer service server employing the print path discovery component to send instructions to a client device 350 for the printing of a test page which the client device 350 then communicates to the one or more printers. Upon learning the printing path of the printer 170, the printing service server can then format a double sided print job and provide a user at client device 350 with instructions for loading pages of a second portion of the double sided print job.

To facilitate performance and scheduling of manual duplex jobs over a network 340, print path discovery component 110 can also include request component 320. Request component 210 can receive requests for double sided printing jobs from a client device 350 via the network 340. In an aspect, the request component 320 can receive a request for a double sided printing job from a device connected or configured to connect to, one or more printers 170. In an embodiment, in response to receipt of a request for a double sided printing job, the request component 320 can determine if one or more printers connected to client device 350 provide automatic duplexing. If a printer does not provide automatic duplexing, the request component 320 can ask the user, via a prompt, if the user would like to perform manual duplexing using a printer 170. In turn, to an affirmative answer, the instruction component 120 can initiate the subject manual duplexing configuration process. In another aspect, the request component 320 may receive a request for a double sided print job from a client device 350 for which a user desires manual duplexing. In particular, the request may indicate that manual duplexing is desired. According to this aspect, the instruction component 120 can initiate the subject manual duplexing configuration process in response to the request.

In particular, the printer service server 310 can employ print path discovery component 110 to communicate instructions to a user at a client device. In turn, the user and/or client device can perform the instructions provided by the printing server 310 and communicate responses to the response component 130 via the network 340. For example, the instruction component 120 can provide instructions, such as those discussed supra, for printing and reprinting a test page, as a series of prompts in a browser at the client device 350. The user can further provide the response component 130 information through interaction with the printing server 310 at the browser (e.g. via an input device at the client device 350).

In an aspect, the client device 350 can communicate commands to the printer 170 provided by the printing server 310. For example, the print path discovery component 110 can instruct, via instruction component, a user to print a test page with the four boxes as configured by print path discovery component. However, in an aspect, the printing server can instruct the client device to initiate printing of the test page at the acquiescence of the user. In another, example, the client device 350 can communicate a command to scan a twice printed test page and send the scanned image to the printing server 310 for analysis. It should be appreciated that the client device 350 can communicate any type of command to a printer 170 provided by the printing server 310 that may facilitate discovery of printing path information, including commands to perform actions discussed infra that direct sensor component 180. Further, the client device, user of the client device, or printer itself 170, may communicate responses to such actions to printing service 310 via the network.

Figure 4:
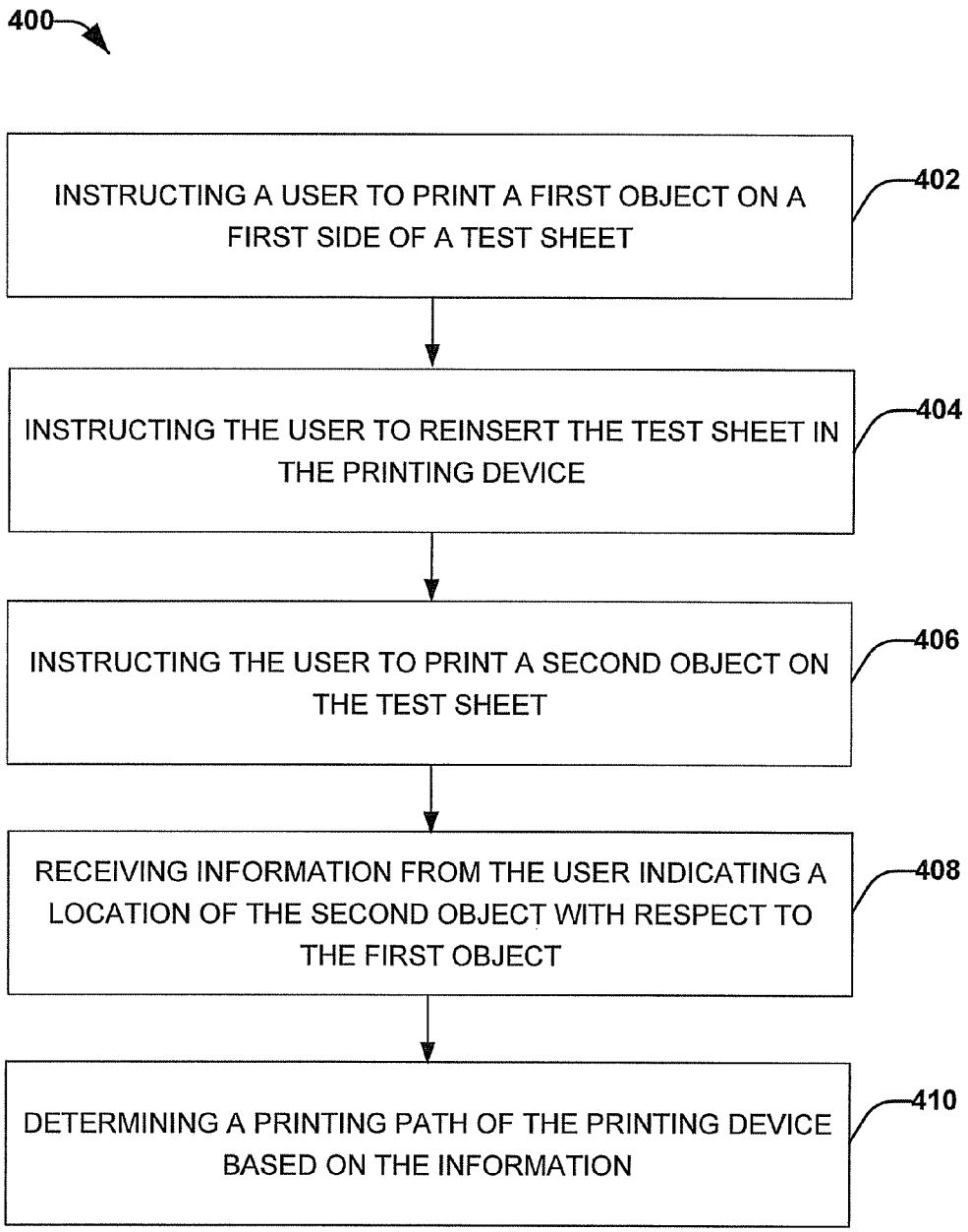
FIG. 4 presents an example methodology for determining the printing path of a printer in accordance with various aspects and implementations described herein.
Figure 5:
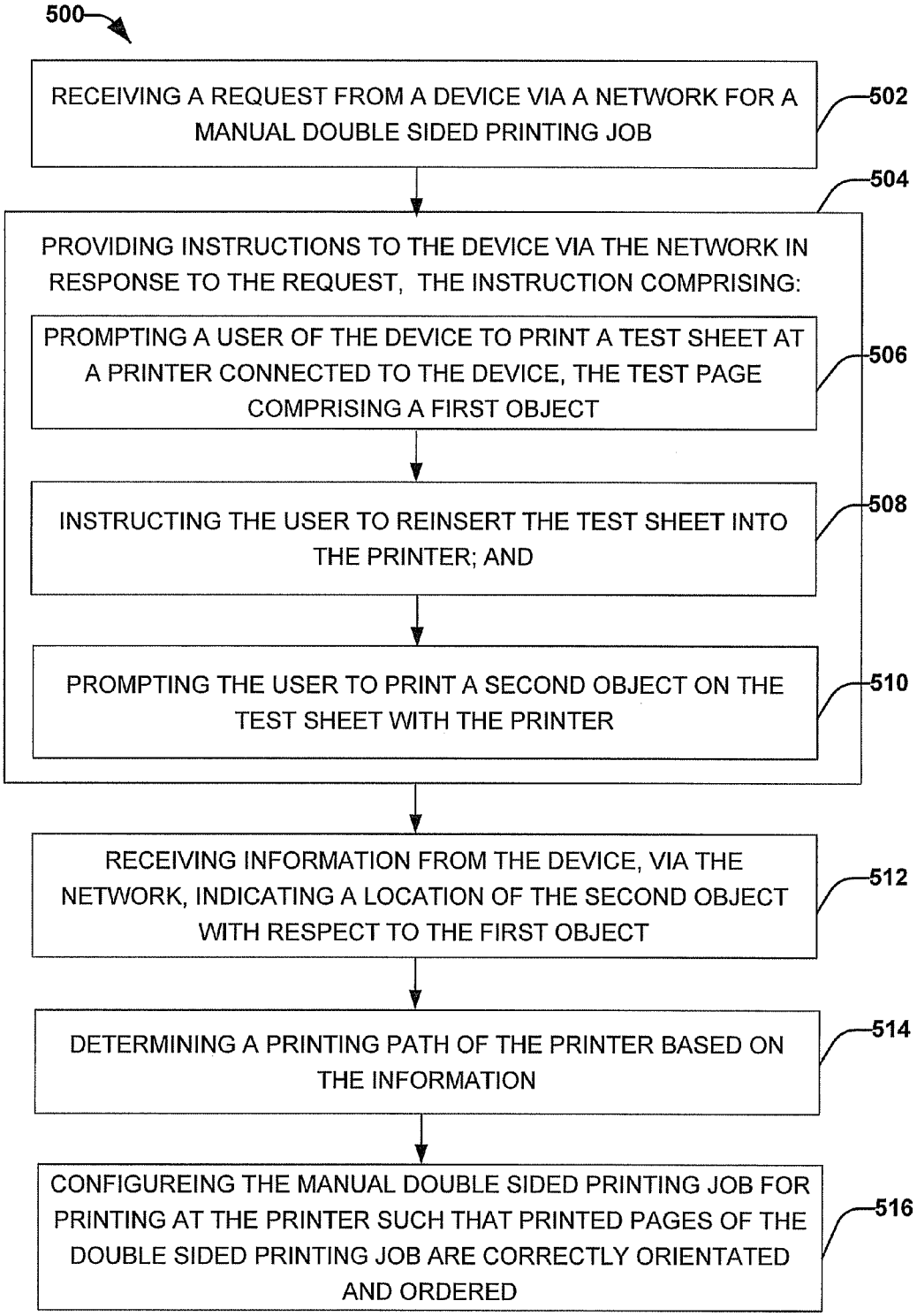
FIG. 5 presents another example methodology for determining a printing path of a printer and instructing a user how to perform manual duplexing in association therewith in accordance with various aspects and implementations described herein.

FIGS. 4-5 illustrate methodologies or flow diagrams in accordance with certain aspects of this disclosure. While, for purposes of simplicity of explanation, the methodologies are shown and described as a series of acts, the disclosed subject matter is not limited by the order of acts, as some acts may occur in different orders and/or concurrently with other acts from that shown and described herein. For example, those skilled in the art will understand and appreciate that a methodology can alternatively be represented as a series of interrelated states or events, such as in a state diagram. Moreover, not all illustrated acts may be required to implement a methodology in accordance with the disclosed subject matter. Additionally, it is to be appreciated that the methodologies disclosed in this disclosure are capable of being stored on an article of manufacture to facilitate transporting and transferring such methodologies to computers or other computing devices.

An example methodology 400 for determining the printing path of a printer as described herein is presented in FIG. 4. In an aspect, in exemplary methodology 400, a print path discovery component/system is stored in a memory and utilizes a processor to execute computer executable instructions to perform functions. Reference is made to the figures described above for ease of description. However, the method 400 is not limited to any particular embodiment or example provided within this disclosure.

At 402, a user is instructed to print a first object on a first side of a test sheet. For example, the user can be instructed to print a test sheet comprising four boxes, one in each of the respective corners of the test page. Each of the boxes can further have identifiers therein, such as different letters of the alphabet. At 404, the user is instructed to reinsert the test sheet in the printing device. For example, the user can be instructed to place the test sheet in a loading tray of the printer in a predetermined manner (e.g. print side up, not inverted). At 406, the user is instructed to print a second object on the test sheet. For example, the user can be instructed to print an X mark or a check mark on the test sheet in a corner of the test sheet. At 408, information is received from the user indicating a location of the second object with respect to the first object. For example, the user may provide information indicating that the X mark is located in a box having the letter A. Then, at 410, the printing path of the printing device is determined based on the information.

Another example methodology 500 determining for the printing path of a printer as described herein is presented in FIG. 5. In an aspect, in exemplary methodology 500, a print path discovery component/system is stored in a memory and utilizes a processor to execute computer executable instructions to perform functions. Reference is made to the figures described above for ease of description. However, the method 500 is not limited to any particular embodiment or example provided within this disclosure.

At 502, a request for a manual double sided print job is received from a device over a network. At 504, instructions are provided to the device, via the network, in response to the request. The instruction can include: prompting a user of the device to print a test sheet at a printer connected to the device, the test page comprising a first object at 506; instructing the user to reinsert the test sheet into the printer at 508; and prompting the user to print a second object on the test sheet with the printer at 510. Then at 512, information is received from the device via the network. The information can be provided the user or a web based camera at the device for example, and include information indicating a location of the second object with respect to the first object. At 514, the printing path of the printer is determined based on the information. At 516, the manual double sided printing job is configured for printing at the printer such that the printed pages of the double sided printing job are correctly orientated and ordered. The configured printing job can further be communicated to the device and/or the printer via the network.

Many variations and modifications can be made to the above-described examples. All such modifications and variations are intended to be included herein within the scope of the disclosure and protected by the following claims. It will be noted that the singular forms "a," "an," and "the" include plural references unless the context clearly indicates otherwise.

What is claimed is:

1. A method comprising:

using at least one microprocessor to execute computer executable instructions stored on at least one non-transitory computer readable medium to perform the following acts:

outputting an instruction to instruct a user to print a first object on a first side of a test sheet on a printing device;

outputting an instruction to instruct the user to reinsert the test sheet in the printing device;

outputting an instruction to instruct the user to print a second object on the test sheet;

receiving location information indicating a location of the second object with respect to a location of the first object on the test sheet; and determining a printing path of the printing device based on the location information, wherein the printing path comprises a manner in which the printing device is to feed a sheet of paper through the printing device and affix an object onto the sheet of paper.

2. The method of claim 1, wherein the determining the printing path includes determining whether the printing device inverts a page prior to printing on the page.

3. The method of claim 1, wherein the determining the printing path includes determining whether the printing device prints on a front side of a page or a back side of a page.

4. The method of claim 1, further comprising:

based on the printing path, outputting an instruction to instruct the user how to reinsert one or more printed pages into the printing device to so that the printing device can perform a second portion of a double sided printing job such that a first side of the one or more printed pages has print thereon in predetermined orientation with respect to a second side of the one or more printed pages, wherein the one or more printed pages have print thereon as a result of a first portion of the printing job.

5. The method of claim 1, further comprising:

determining a printing order to apply to a printing job requesting double sided printing based on the printing path.

6. The method of claim 1, further comprising:

providing the instructions to the user at a client device via a network and receiving the information from the user via the network as input to the client device.

7. A system comprising:

a memory having stored thereon computer executable components; and a processor to execute the following computer executable components stored in the memory:

a print path discovery component comprising:

an instruction component that provides instructions to a client device via a network, the instructions prompting a user to print at a printer connected to the client device, a test sheet comprising a first object on a first side, the instructions further prompting the user to reinsert the test sheet into the printer and to print a second object on the test sheet;

a response component that receives location information from the client device indicating a location of the second object with respect to a location of the first object on the test sheet; and an analysis component that determines a printing path of the printer based on the location information, wherein the printing path comprises a manner in which the printer is to feed a sheet of paper through the printer and affix an object onto the sheet of paper.

8. The system of claim 7, wherein the analysis component determines whether the printer inverts a page prior to printing on the page.

9. The system of claim 7, wherein the analysis component determines whether the printer prints on a front side of a page or a back side of a page.

10. The system of claim 7, wherein the analysis component configures a double sided printing job based on the printing path and wherein the instruction component further provides instructions to the client device via the network that instructs the user how to reinsert one or more printed pages into the printer, based on the printing path, so that the printer can perform a second portion of the double sided printing job such that a first side of the one or more printed pages has print thereon in predetermined orientation with respect to a second side of the one or more printed pages, wherein the one or more printed pages have print thereon as a result of a first portion of the printing job.

11. The system of claim 7, wherein the analysis component further determines a printing order to apply to a printing job requesting double sided printing based on the printing path.

12. The system of claim 7, further comprising:

a communication component that communicates the instructions to the client device via the network.

13. The system of claim 12, further comprising:

a request component that receives a request over the network from the client device for a double sided printing job, wherein the instruction component provides the instructions in response to the request.

14. A non-transitory computer readable medium storing thereon machine readable instructions, which when executed cause a processor to:

provide instructions to a client device over a network, the instructions prompting a user to print at a printer connected to the client device, a test sheet comprising a first object on a first side, the instructions further prompting the user to reinsert the test sheet into the printer and to print a second object on the test sheet;

receive location information from the client device indicating a location of the second object with respect to a location of the first object on the test sheet; and determine a printing path of the printer based on the location information, wherein the printing path comprises a manner in which the printer is to feed a sheet of paper through the printer and affix an object onto the sheet of paper.

15. The non-transitory computer readable medium of claim 14, wherein the machine readable instructions further cause the processor to:

configure a manual double sided printing job for printing at the printer such that printed pages of the manual double sided printing job are correctly orientated and ordered; and communicate the double sided print job to the client device via the network.

* * * * *